US005846108A

United States Patent [19]

Milford

[11] Patent Number: 5,846,108

[45] Date of Patent: Dec. 8, 1998

[54] SKI DISK

[76] Inventor: Larry R. Milford, 26 Fourth Ave N, Uxbridge, Ontario, Canada, L9P 1V5

[21] Appl. No.: 842,905

[22] Filed: Apr. 17, 1997

[51] Int. Cl.[6] ..... B63B 1/00

[52] U.S. Cl. ..... 441/67; 441/65

[58] Field of Search ..... 441/65, 66–68, 441/69, 74; 114/346; D21/228, 229

[56] References Cited

U.S. PATENT DOCUMENTS

| | | | |
|---|---|---|---|
| 3,716,880 | 2/1973 | Sorenson | 441/67 |
| 4,386,915 | 6/1983 | Gilliam | 441/68 |
| 4,463,954 | 8/1984 | Panse et al. | 441/67 |
| 4,613,131 | 9/1986 | Anderson | 441/67 |
| 4,883,436 | 11/1989 | Oakland | 441/65 |

*Primary Examiner*—Ed Swinehart

[57] ABSTRACT

A new ski disk for supporting a user while being towed behind a boat. The inventive device includes a circular disk member having a central planar portion and an upturned outer edge portion. A non-slip pad is attached to the top of the central portion to provide cushioning to the user. A track member is secured to the central portion and is embedded within the non-slip pad so that it does not extend beyond the top of the pad. A pair of foot holds are connected to the track member in a manner permitting adjustment of the foot holds relative to the track member, or else the foot holds can be removed when they are not to be used.

10 Claims, 3 Drawing Sheets

SKI DISK

BACKGROUND OF THE INVENTION

1. Field of the Invention

The present invention relates to ski devices and more particularly pertains to a new ski disk for supporting a user while being towed behind a boat.

2. Description of the Prior Art

The use of ski devices is known in the prior art. More specifically, ski devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art ski devices include U.S. Pat. No. 5,257,953; U.S. Pat. No. 5,080,620; U.S. Pat. No. 4,604,070; U.S. Pat. No. 4,678,445; U.S. Pat. No. 4,850,914 and U.S. Pat. No. Des. 257,672.

While these devices fulfill their respective, particular objectives and requirements, the aforementioned patents do not disclose a new ski disk. The inventive device includes a circular disk member having a central planar portion and an upturned outer edge portion. A non-slip pad is attached to the top of the central portion to provide cushioning to the user. A track member is secured to the central portion and is embedded within the non-slip pad so that it does not extend beyond the top of the pad. A pair of foot holds are connected to the track member in a manner permitting adjustment of the foot holds relative to the track member, or else the foot holds can be removed when they are not to be used.

In these respects, the ski disk according to the present invention substantially departs from the conventional concepts and designs of the prior art, and in so doing provides an apparatus primarily developed for the purpose of supporting a user while being towed behind a boat.

SUMMARY OF THE INVENTION

In view of the foregoing disadvantages inherent in the known types of ski devices now present in the prior art, the present invention provides a new ski disk construction wherein the same can be utilized for supporting a user while being towed behind a boat.

The general purpose of the present invention, which will be described subsequently in greater detail, is to provide a new ski disk apparatus which has many of the advantages of the ski devices mentioned heretofore and many novel features that result in a new ski disk which is not anticipated, rendered obvious, suggested, or even implied by any of the prior art ski devices, either alone or in any combination thereof.

To attain this, the present invention generally comprises a circular disk member having a central planar portion and an upturned outer edge portion. A non-slip pad is attached to the top of the central portion to provide cushioning to the user. A track member is secured to the central portion and is embedded within the non-slip pad so that it does not extend beyond the top of the pad. A pair of foot holds are connected to the track member in a manner permitting adjustment of the foot holds relative to the track member, or else the foot holds can be removed when they are not to be used.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski disk apparatus which has many of the advantages of the ski devices mentioned heretofore and many novel features that result in a ski disk which is not anticipated, rendered obvious, suggested, or even implied by any of the prior art ski devices, either alone or in any combination thereof.

It is another object of the present invention to provide a new ski disk which may be easily and efficiently manufactured and marketed.

It is a further object of the present invention to provide a new ski disk which is of a durable and reliable construction.

An even further object of the present invention is to provide a new ski disk which is susceptible of a low cost of manufacture with regard to both materials and labor, and which accordingly is then susceptible of low prices of sale to the consuming public, thereby making such ski disk economically available to the buying public.

Still yet another object of the present invention is to provide a new ski disk which provides in the apparatuses and methods of the prior art some of the advantages thereof, while simultaneously overcoming some of the disadvantages normally associated therewith.

Still another object of the present invention is to provide a new ski disk for supporting a user while being towed behind a boat.

Yet another object of the present invention is to provide a new ski disk which includes a circular disk member having a central planar portion and an upturned outer edge portion. A non-slip pad is attached to the top of the central portion to provide cushioning to the user. A track member is secured to the central portion and is embedded within the non-slip pad so that it does not extend beyond the top of the pad. A pair of foot holds are connected to the track member in a manner permitting adjustment of the foot holds relative to the track member, or else the foot holds can be removed when they are not to be used.

Still yet another object of the present invention is to provide a new ski disk that increases user safety by eliminating sharp edges, using padded standing/sitting areas, using adjustable foot hold straps, and by designing the disk so that it moves away from the user in the opposite direction from a fall.

Even still another object of the present invention is to provide a new ski disk that is easy to use by people of all ages, while at the same time teaching balancing and skiing skills.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
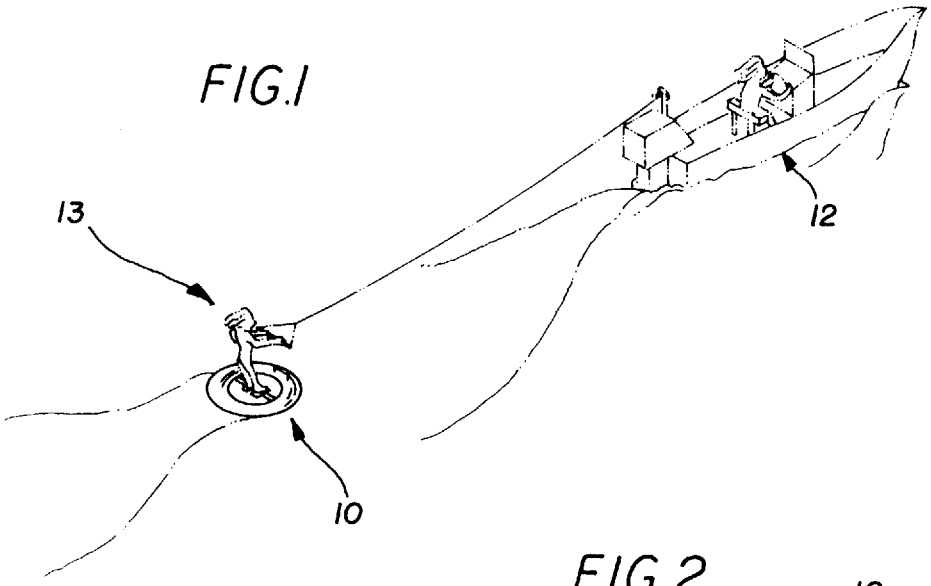
FIG. 1 is a view of a new ski disk according to the present invention in use being towed behind a boat.

With reference now to the drawings, and in particular to FIGS. 1 through 6 thereof, a new ski disk embodying the principles and concepts of the present invention and generally designated by the reference numeral 10 will be described.

More specifically, it will be noted that the ski disk 10 is intended to be towed behind a boat 12, similar to conventional kneeboards, inner tubes, and other ski devices. A person 13 either stands, sits, or kneels on the disk 10 while grasping a tow line connected to the boat 12.

Figure 2:
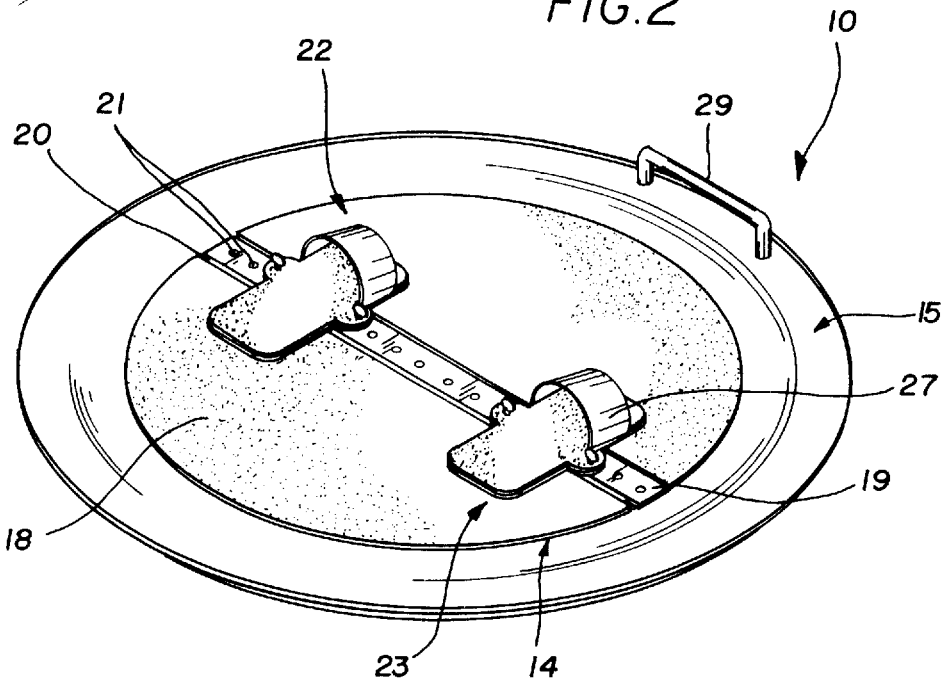
FIG. 2 is an elevated, right side perspective view of the ski disk.
Figure 3:
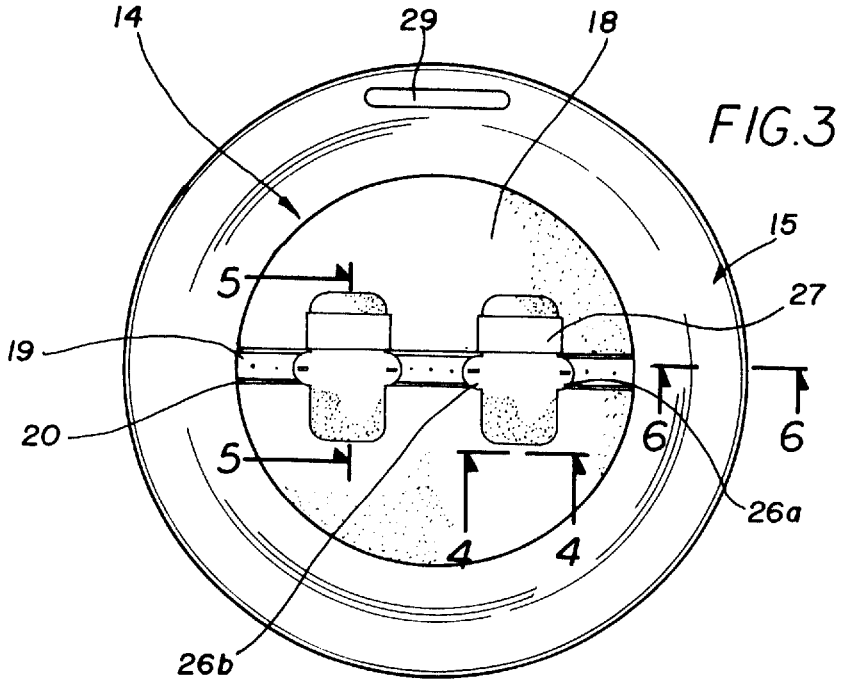
FIG. 3 is a top view of the ski disk.
Figure 4:
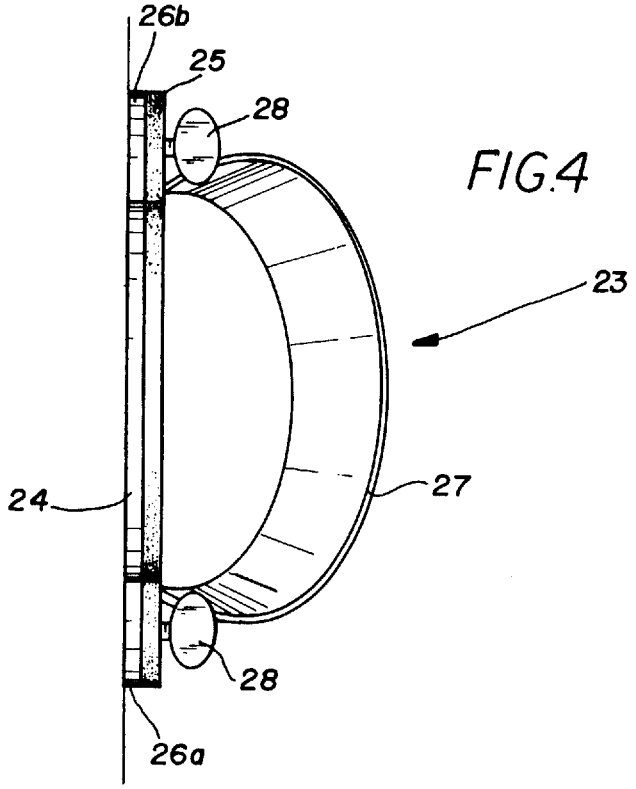
FIG. 4 is a view taken generally in the direction of line 4—4 in FIG. 3.

The ski disk 10, as best shown in FIGS. 2 and 3, is substantially circular in shape and includes top and bottom surfaces, a generally planar, horizontal central portion 14, and an outer edge portion 15 surrounding the central portion 14. The disk 10 can have a diameter of about 4 feet, with a thickness of about 1 inch, although other diameters and thicknesses can be used if desired.

Figure 6:
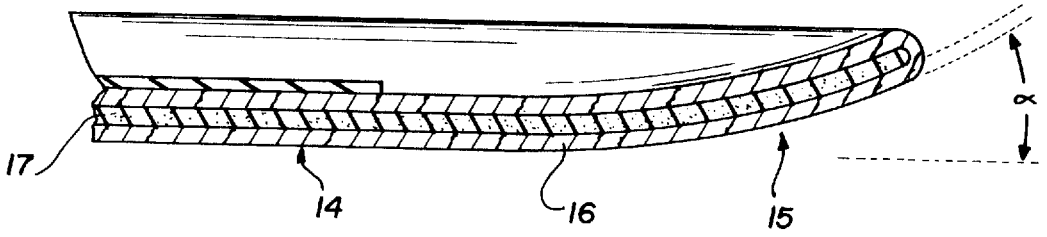
FIG. 6 is a cross sectional view taken along line 6—6 of FIG. 3.

As seen in FIG. 6, the outer edge portion 15 is upturned relative to the central portion 14 at an angle $\alpha$, in order to permit the disk 10 to ride upon the water. The angle $\alpha$ is preferably about 5 degrees or less, but should be greater than zero so that the outer edge does not bite into the water. Thus the disk 10 has a generally concave appearance. The disk 10 is made of a graphite composite or plastic outer shell 16 to give the disk rigidity, with a foam inner layer 17 to make the disk lightweight and so that it is able to float in water.

Figure 5:
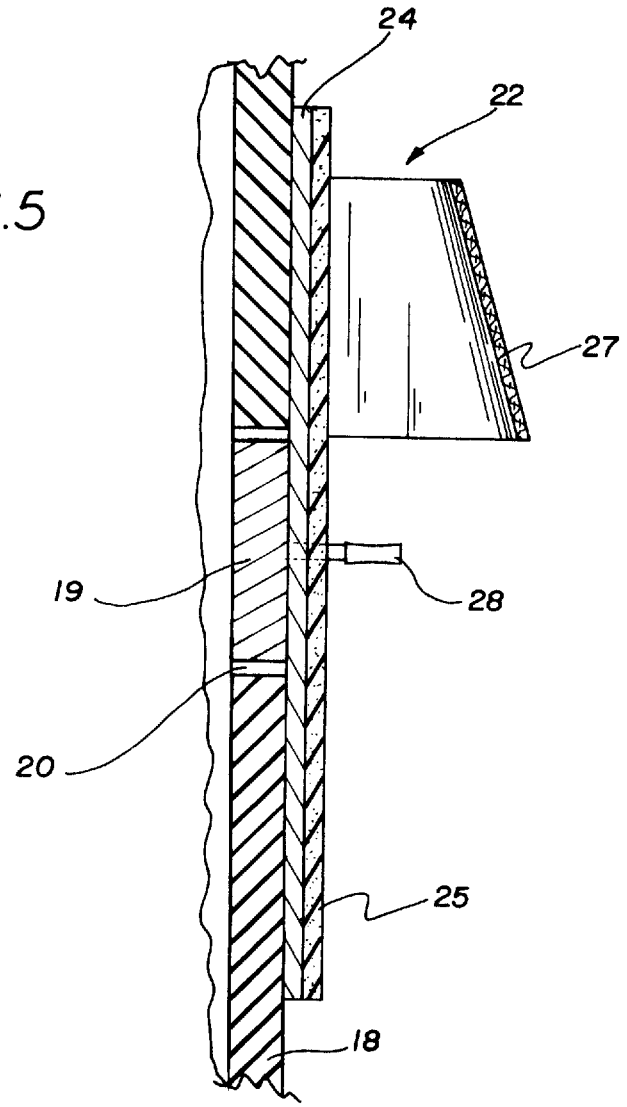
FIG. 5 is a cross sectional view taken along line 5—5 of FIG. 3.

As best illustrated in FIGS. 2 and 3, a circular non-slip pad 18 is secured to the top surface of the disk so as to cover the majority of the central portion 14. The pad 18 is preferably foam rubber or the like, and has a thickness of about 0.5 inch. The pad 18 is divided into two generally equal portions by a track member 19 which is disposed in a slot 20 provided between the two pad portions. The track member 19 extends across the diameter of the pad 18, and can be either directly secured to the top surface of the central portion, as shown, or can be partially sunk into the central portion. In either event, the top of the track member 19 should not extend above the top surface of the pad 18 (FIG. 5 shows the top of the track member level with the top of the pad; however the top of track can be disposed below the top of the pad if desired). Such a configuration provides increased user comfort, since the user is less likely to contact the track member while in use.

The track member 19 includes a plurality of longitudinally spaced holes 21 therein, which provide a means for adjustably connecting foot holds 22,23 to the disk. The foot holds 22,23 are identical and generally include a planar base member 24 with a non-slip covering 25 of foam rubber, or the like, secured to the top of the member 24. A pair of semi-circular wings 26*a,b* extend from the sides of the member 24, with an aperture extending through each wing 26*a,b*. A strap 27 is appropriately secured to the base member 24 so as to provide a means for holding the users foot on each foot hold 22,23. The strap 27 is preferably an adjustable strap made from hook and loop type materials, so that the strap 27 can be adjusted to different users.

The foot holds 22,23 are disposed on the disk such that the wings 26*a,b* are disposed on the track member 19 and the apertures in the wings 26*a,b* align with the holes 21. The foot holds 22,23 are then secured in place using fasteners 28 extending through the apertures in each wing 26*a,b* and into the holes 21. Preferably, the fasteners 28 are wing nuts which are threaded at one end, which requires that the holes 21 be threaded. The foot holds can be secured using other type of fastening systems, such as using fasteners which lock into the holes in the track member using a bayonet-type of locking action. It is apparent that the foot holds 22,23 can be adjusted along the track member by loosening the fasteners and sliding the foot holds in either direction until the apertures align with the holes. The fasteners are then retightened. Thus the stance that the user assumes while his/her feet are in the foot holds can be altered by adjusting the spacing between the foot holds. If the user is not going to use the foot holds, they can be easily removed from the disk by loosening the fasteners and removing the foot holds.

In order to make it easier to climb onto the disk, and to provide a place for attachment of the tow line, a U-shaped handle 29 is secured to the outer edge portion 15. The handle 29 should be generally parallel to the track member 19.

In use, the rider can either stand, sit, or kneel upon the disk while it is being towed behind the boat. If the rider chooses to stand, he places his feet within the foot holds and tightens the straps, and grabs hold of the tow line with his hands and is pulled along behind the boat, similar to conventional water skiing. The stance of the rider can be altered by loosening the fasteners holding the foot holds in place and adjusting the spacing between the foot holds. If the rider chooses to sit or kneel on the disk, and the foot holds are in the way, the rider can easily remove the foot holds by loosening the fasteners and lifting the foot holds from the disk. The rider will then be unencumbered by the foot holds during the ride. Alternatively to using the disk in water, the disk could also be used as a snow-sled in winter.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ski device, comprising:

a circular disk member having top and bottom surfaces, a planar central portion, and an outer edge portion surrounding the central portion, said outer edge portion being upturned at a predetermined angle relative to the central portion;

a non-slip pad attached to at least a portion of the top surface of the central portion;

at least one foot hold attached to the central portion; and a track member secured to the top surface of the central portion and embedded within the non-slip pad, the track member including a top surface which does not extend beyond a top surface of the non-slip pad.

2. The ski device according to claim 1, wherein said predetermined angle is at most about 5 degrees.

3. The ski device according to claim 1, wherein said at least one foot hold is laterally adjustable relative to said central portion.

4. The ski device according to claim 1, wherein said track member includes a plurality of longitudinally spaced holes therein, and said at least one foot hold includes at least one aperture therethrough which is aligned with one of said holes, and a fastener extending through the at least one aperture in the at least one foot hold and into one of the holes to prevent movement of the at least one foot hold with respect to the track member.

5. The ski device according to claim 4, wherein said holes are threaded holes, and said fastener is a wing nut.

6. A ski device, comprising:

a circular disk member having top and bottom surfaces, a planar central portion, and an outer edge portion surrounding the central portion, said outer edge portion being upturned at a predetermined angle relative to the central portion;

a non-slip pad attached to at least a portion of the top surface of the central portion; and at least one foot hold attached to the central portion; and wherein said at least one foot hold includes a planar base member having a non-slip material secured thereto, and a strap means attached to the at least one foot hold for holding a foot thereon.

7. The ski device according to claim 6, wherein said predetermined angle is at most about 5 degrees.

8. The ski device according to claim 6, wherein said at least one foot hold is laterally adjustable relative to said central portion.

9. The ski device according to claim 6, wherein said track member includes a plurality of longitudinally spaced holes therein, and said at least one foot hold includes at least one aperture therethrough which is aligned with one of said holes, and a fastener extending through the at least one aperture in the at least one foot hold and into one of the holes to prevent movement of the at least one foot hold with respect to the track member.

10. The ski device according to claim 9, wherein said holes are threaded holes, and said fastener is a wing nut.

* * * * *